United States Patent [19]

Morgan

[11] Patent Number: 4,833,485

[45] Date of Patent: May 23, 1989

[54] RADAR ANTENNA ARRAY

[75] Inventor: Thomas E. Morgan, Greenford, England

[73] Assignee: The Marconi Company Limited, England

[21] Appl. No.: 863,953

[22] Filed: May 16, 1986

[30] Foreign Application Priority Data

May 17, 1985 [GB] United Kingdom ..... 8512487

[51] Int. Cl.[4] ..... H01Q 1/36; H01Q 1/28

[52] U.S. Cl. ..... 343/895; 343/705

[58] Field of Search ..... 343/705, 708, 789, 895; 342/424, 443, 445

[56] References Cited

U.S. PATENT DOCUMENTS

| | | | |
|---|---|---|---|
| 3,152,330 | 10/1964 | Chatelain | 343/705 |
| 3,192,531 | 6/1965 | Cox et al. | 343/789 |
| 3,553,698 | 1/1971 | Keller | 343/895 |
| 3,820,118 | 6/1974 | Hall | 343/895 |
| 4,143,380 | 3/1979 | Kyle | 343/895 |
| 4,284,991 | 8/1981 | Dupressior | 343/771 |
| 4,380,012 | 4/1983 | Beran et al. | 343/705 |
| 4,387,379 | 6/1983 | Hardie | 343/895 |

FOREIGN PATENT DOCUMENTS

| | | | |
|---|---|---|---|
| 0030272 | 6/1981 | European Pat. Off. | 343/781 CA |
| 0032604 | 7/1981 | European Pat. Off. | 343/912 |
| 943710 | of 0000 | Fed. Rep. of Germany . | |
| 0429743 | 12/1982 | U.S.S.R. | 343/705 |
| 1057489 | of 0000 | United Kingdom . | |
| 1280668 | of 0000 | United Kingdom . | |
| 1465658 | of 0000 | United Kingdom . | |
| 1508726 | of 0000 | United Kingdom . | |
| 1555591 | of 0000 | United Kingdom . | |
| 2089579 | of 0000 | United Kingdom . | |

*Primary Examiner*—Rolf Hille
*Assistant Examiner*—Doris J. Johnson
*Attorney, Agent, or Firm*—Kirschstein, Ottinger, Israel & Schiffmiller

[57] ABSTRACT

A close-packed divergent array of cavity-backed antennas for use in the radome of a missile. Each antenna cavity is tapered from its radiating face towards its base so that the antennas can be mounted more closely together while their radiating faces maintain conformity with the streamlined surface. The array can thus be moved farther into the apex of the radome with a consequent reduction of the antenna divergence angle and greater sensitivity in the boresight region.

5 Claims, 2 Drawing Sheets

RADAR ANTENNA ARRAY

BACKGROUND OF THE INVENTION

1. Field of the Invention

The present invention relates to cavity-backed antennas and to close-packed arrays of such antennas. The invention relates particularly to cavity-backed spiral antennas and especially to close-packed divergent arrays of such antennas when mounted near the forward tip of a pointed radome and incorporated in an amplitude-comparison monopulse radar system.

2. Description of Related Art

Cavity-backed spiral antennas operating over large radio frequency bandwidths are currently available with cylindrical cavities which are filled with radar absorbent material (RAM) and terminated by a balun box, and are used in monopulse radar systems. In an amplitude comparison configuration, in which the antenna axes diverge from the boresight, the diameter of the array is defined by the lowest frequency to be detected since this frequency determines the maximum spiral diameter required, by the size of the cavity, which must be sufficient to provide absorption of substantially all of the reverse-radiated emission from the spiral, and by the size of the balun box. For reasons which are explained below, it is desirable to minimize this diameter so that the array can be mounted as close as possible to the forward tip of a pointed radome, at the nose of a missile for example. However for a given bandwidth the diameter of the array is largely determined by the size, i.e. the depth, of each cavity. There is little scope for reducing the cavity depth because of the requirement to absorb the reverse-radiated emission from the spiral antenna (which would otherwise interfere with the forward beam).

Thus it has not been possible, hitherto, to mount arrays of cavity-backed antennas close to the forward tip of a streamlined radome housing, and consequently a serious problem arises. Since the radiating faces of the cavity-backed antenna face the inner surface of the surrounding radome and are typically separated from this surface by only a few millimeters, the respective divergent axes of the antennas are necessarily substantially normal to the radome surface. Consequently the antenna axes diverge from the boresight by an angle of typically 70°, so that the forward view performance of the array is poor because target return signals from the boresight direction are badly distorted by virtue of their large angle of incidence at the antennas. It is not practicable to reduce the divergence of the antenna axes by making the radome nose blunter, because the aerodynamic performance of the radome is then reduced and results in significant extra drag.

SUMMARY OF THE INVENTION

It is an object of the present invention to provide an array of cavity-backed antennas in which the mutual divergence between the antenna axes is reduced.

According to the present invention, in a close-packed divergent array of cavity-backed antennas, each antenna cavity is tapered from the radiating face of the antenna towards the base of the cavity, the antennas being mounted with their cavity bases closely adjacent. The arrangement may be such that their radiating faces substantially conform to a streamlined surface.

Thus the array can be closely housed within a pointed streamlined radome near the forward tip thereof. The radome may be located at the nose of a missile, for example.

BRIEF DESCRIPTION OF THE DRAWINGS

One embodiment of the invention will now be described by way of example with reference to the accompanying drawings, of which.

DESCRIPTION OF THE PREFERRED EMBODIMENT

Figure 1:
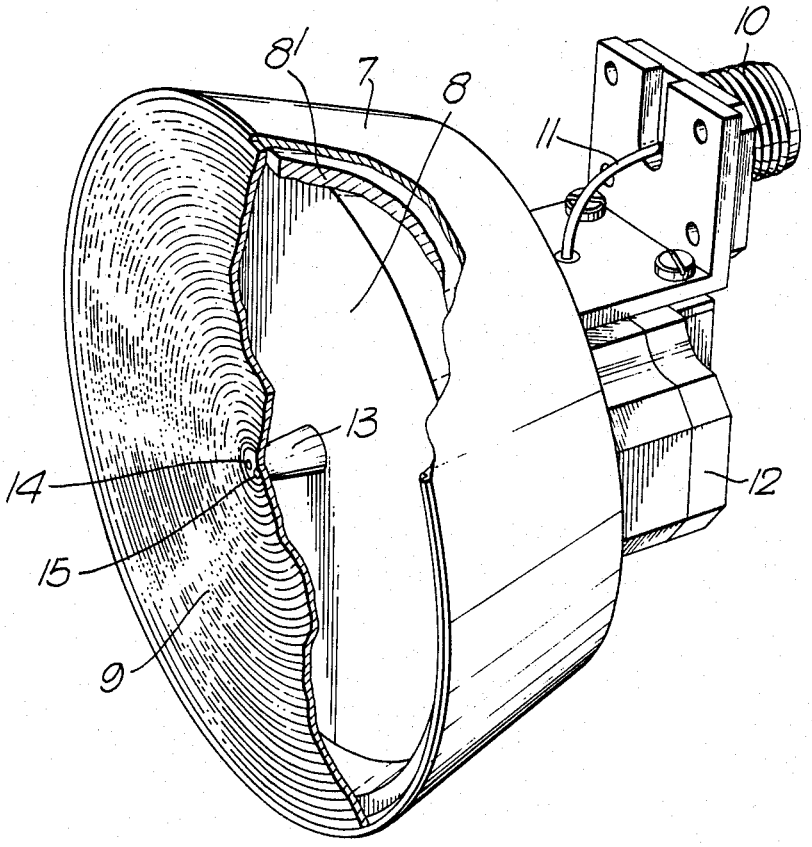
FIG. 1 is a sketch perspective view, partially cut away, showing a cavity-backed spiral antenna suitable for use in an array according to the present invention.

Referring to FIG. 1, the antenna unit shown comprises a frusto-conical metal housing 7 the cavity of which is filled with radar absorbent material (RAM) 8 and incorporates a spiral radiator 9 (approximately 50 mm in diameter) at its major face . A space of a few millimeters between the RAM filling 8 and the spiral radiator 9 prevents the material from absorbing all the energy of radiation, including that which would be radiated forwards. The housing 7 also contains a lining 8' of other radar absorbent material. Spiral radiator 9 is of conventional type and consists of a disc of dielectric material on the outer surface of which two metallic tracks in the form of interleaved Archimedean spirals are printed. These tracks (which are not shown in detail) are connected to respective connection points 14 and 15. Monopulse radar signals are conducted between connection points 14 and 15 and connector 10 via a balun 12, which is connected to connection points 14 and 15 via a feed/screen post 13 and to connector 10 via a coaxial cable 11.

Figure 2:
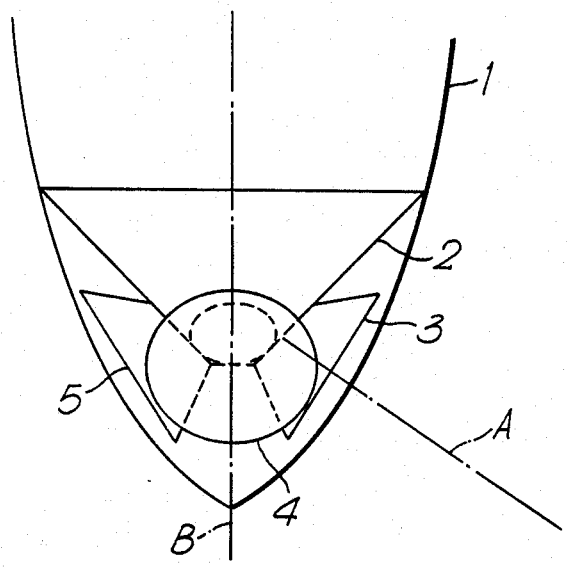
FIG. 2 is a plan view of a missile nose incorporating a monopulse radar array of the antennas of FIG. 1.
Figure 3:
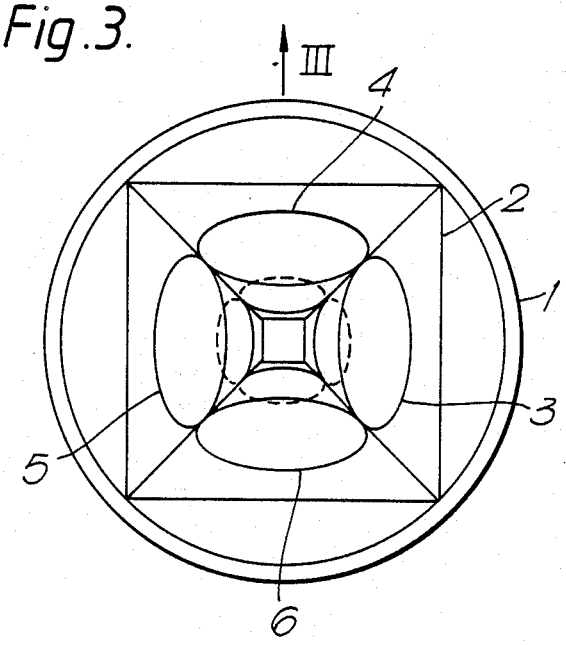
FIG. 3 is a front elevation taken in the direction III on FIG. 2, with the forward tip of the radome cut away to reveal the antenna array.

FIGS. 2 and 3 show four antennas 3, 4, 5 and 6 of the type shown in FIG. 1 mounted on a square pyramidal support 2 in a close-packed divergent array. The array is housed within a streamlined radome nose 1 of a missile, near the tip of the nose. Because the bases of the antennas 3, 4, 5 and 6 are much smaller than the outwardly facing spiral radiator surfaces, the antennas can be mounted close together and their spiral radiator surfaces therefore conform to the streamlined surface of radome 1. Consequently, undesirable diffraction effects, which tend to arise when the radome surface is not perpendicular to the radiative axis (indicated at A), are much reduced. This advantage is achieved without compromising the forward view performance of the array since the angle between the boresight B and the radiative axis A is quite small, i.e. considerably less than 70°.

I claim:

1. A divergent antenna array, comprising:

(A) a plurality of cavity-backed antennas, each including (i) an outer radiating surface for outwardly radiating signals generally along an antenna axis, and (ii) a housing enclosing a cavity having a base, said cavity tapering from the outer radiating surface along the antenna axis to the base;

(B) a support having a boresight axis; and (C) means for mounting the antennas on the support in a packed divergent state in which (i) each base faces toward, and each radiating surface faces away from, the support, (ii) each antenna axis and its corresponding outwardly radiated signals diverge away from the boresight axis at an acute angle, and (iii) said antenna axes are spaced closer together at the bases, and further apart at the outer radiating surfaces.

2. The array according to claim 1, wherein the support is mounted in an elongated radome having a curved front portion and having a boresight axis coincident with the boresight axis of the support, each outer radiating surface conforming to an inner curved surface of the front portion.

3. The array according to claim 1, wherein each housing has a frusto-conical shape, each base has a circular shape and a center, and each radiating surface has a circular shape and a center; and wherein each antenna axis passes through the centers of a respective base and a radiating surface; and wherein the centers of the bases are arranged along a first circle having a diameter which is smaller than a second circle along which the centers of the radiating surfaces are arranged.

4. The array according to claim 1, wherein the antenna axes are symmetrically arranged about the boresight axis.

5. The array according to claim 1, wherein each acute angle is less than 70° with the boresight axis.

* * * * *